United States Patent [19]

Reiff

[11] 4,361,062

[45] Nov. 30, 1982

[54] PLATE FEEDING APPARATUS FOR A SHEARING DEVICE

[75] Inventor: Harro Reiff, Leipheim, Fed. Rep. of Germany

[73] Assignee: Karl Mengele & Söhne Maschinenfabruk und Eisengiesserei GmbH & Co., Gunzburg, Fed. Rep. of Germany

[21] Appl. No.: 233,152

[22] Filed: Feb. 10, 1981

[30] Foreign Application Priority Data

Mar. 15, 1980 [DE] Fed. Rep. of Germany ..... 3010062

[51] Int. Cl.[3] ..... B26D 5/20

[52] U.S. Cl. ..... 83/71; 83/36; 83/276; 83/281; 83/410; 271/14; 414/121

[58] Field of Search ..... 83/3, 6, 410–415, 83/281, 276, 277, 71; 414/121, 744 B, 752; 271/14

[56] References Cited

U.S. PATENT DOCUMENTS

| | | | |
|---|---|---|---|
| 2,515,548 | 7/1950 | Brogren et al. | 83/412 X |
| 3,877,332 | 4/1975 | Roch | 83/36 X |
| 4,040,318 | 8/1977 | Makeev et al. | 83/281 X |
| 4,235,139 | 11/1980 | Haenni | 83/36 X |

*Primary Examiner*—James M. Meistel

*Attorney, Agent, or Firm*—Toren, McGeady & Stanger

[57] ABSTRACT

In a shearing device for cutting plates, such as sheet metal plates, a plate feeding apparatus includes a carriage mounted for movement above and between a plate feeder and the shearing device. A rotatable carrier is mounted on the carriage for lifting and holding plates. The rotatable carrier can be turned through 360°. A plurality of vacuum suction members are positioned on the carrier for holding the plates.

10 Claims, 3 Drawing Figures

PLATE FEEDING APPARATUS FOR A SHEARING DEVICE

SUMMARY OF THE INVENTION

The present invention is directed to a plate feeding apparatus for use with a shearing device, particularly a sheet metal shears, and the apparatus includes a carriage mounted on rails for movement above a shear table having a hold-down clamp and a plate feeder spaced from the shear table. A carrier with lifting members is supported on the carriage. The lifting members can be hydraulically operated vacuum suction members movable in the vertical direction. Gripping collets are provided for holding and introducing the plates into the shearing device. The operation of the plate feeding apparatus is controlled by a NC-programming circuit.

Plate feeding apparatus of this type permits automatic insertion and automatic holding and feeding of the plates.

In a known plate feeding apparatus of this general type, the sheet metal plates are transferred from a supply source arranged laterally of the plate feeder to the plate feeder. The plates are gripped by a vacuum suction device, are lifted over a carriage provided on the shear table and equipped with gripping collets, with the plates being deposited in front of the collets. Next the collets grip the sheet metal plates placed in front of them and transport the plates to the shear table for trim cutting at the front end of the plates and/or for cutting strips as the plates are fed toward the shearing device.

It is not possible with this known plate feeding apparatus to move the plates in a direction other than in the direction toward the shear device. If other sides of the plates are to be trimmed or the plates are to be cut, the plates must be withdrawn, reoriented and introduced again to the shearing device.

With such an appartus though the plate feeding arrangement and control is elaborate, its applications are rather limited.

Therefore, it is the primary object of the present invention to provide a simpler plate feeding apparatus having a broader range of applications.

In accordance with the present invention, a carrier, mounting vacuum suction devices, is positioned on a carriage movable over the plate supply source and the shear table with the carrier being rotatable through 360°. The gripping collets including lifting means are arranged on the carriage. In accordance with the present invention, the plate feeding apparatus permits a surprising number of operations despite the lack of a separate carriage with a drive and carriage guide. In addition to cutting strips, it is also possible to trim each side of the plates in one clamping operation or to produce blanks of any configuration as long as straight cuts are involved.

To move the carriage, rails are provided with toothed racks and a pinion gearing moves the carriage and is driven by a servomoter. The carriage has bearings held on sliding bars formed on the rails.

The rotatable carrier includes a worm gear in the gear box unit for the vacuum suction members. The worm gear is driven by a servomotor positioned on the gear box unit. To permit exact positioning of the carriage in the direction toward the shearing device, a parallel measuring rack with finer teeth is located alongside one of the guide racks and meshes with a pinion connected to a rotational drive when the carriage moves.

The exact positioning of the rotatable carrier and, therefore, of the plates held by the vacuum suction devices located on the carrier is achieved by a gear wheel for the direct drive of the rotational drive which is provided concentrically about the worm gear.

In another embodiment of the invention, a vacuum suction device with a smaller turning diameter and including lifting means is located in front of the carriage and has a rotational device which can be connected alternating with the other vacuum suction devices to the input of the NC-programming circuit for movement around an axis extending perpendicularly of the direction of movement of the carriage toward and away from the shearing device. Under certain circumstances, the vacuum suction device located on the front of the carriage can completely replace the gripping collets.

In still another embodiment of the present invention, hold-down clamps can be operated in an alternating manner with the gripping collets or the vacuum suction devices with the hold-down clamps retaining the sheet metal plates on the shear table until the collets have gripped the plates. On the other hand, the collets can release the sheet metal plates only when the hold-down clamps press the plates against the shear table or when the suction devices have gripped the plates. Such operation ensures an exact repetition (dimensional stability) of the trimming cuts or of the blanks.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 2:
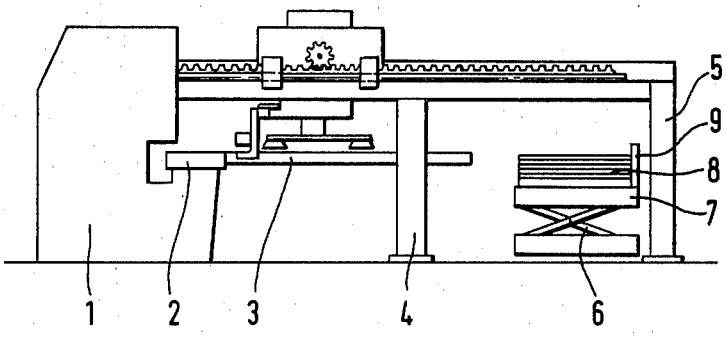
FIG. 2 is a side elevational view on a smaller scale of the apparatus shown in FIG. 1.
Figure 3:
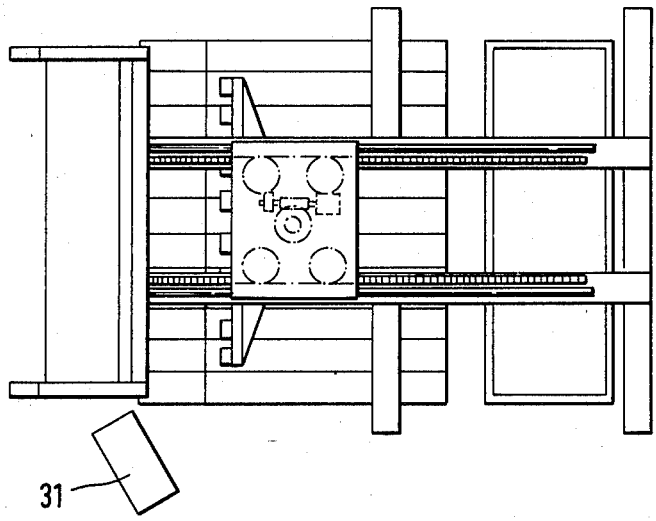
FIG. 3 is a top view also on a smaller scale of the apparatus shown in FIG. 1.

In the drawings a hydraulic shear 1 including a shear table 2 is extended by a support 3 which extends away from the shear table in the direction of movement of plates to and from the hydraulic shears. A pair of portals 4 and 5 are spaced apart from one another and from the shear table 2. Rails 11 are supported on top of the portals 4, 5 and extend outwardly away from the hydraulic shears 1. The rails 11 are spaced above the shear table 2 and the support 3 and are also located above a plate feeder 7 located at the opposite end of the support 3 from the shear table 2. As can be seen in FIG. 2, the plate feeder 7 is moved in the vertical direction by lifting rods 6. Each rail 11 is provided with a sliding bar 12 and a carriage 13 is movably mounted on the sliding bars by means of bearings 14. Carriage 13 can be moved toward and away from the hydraulic shears by pinions 19 in meshed engagement with guide racks 15 formed alongside the sliding bars 12. The pinions 19 are mounted on the opposite ends of a shaft which is driven by a servomotor 20 and a worm gear 21.

In accordance with the present invention, a plurality of vacuum suction devices 22 are positioned on a carrier 24 which can be lifted and lowered by cylinder piston units, not shown, provided on carriage 13. Further, the carrier can be rotated by a drive 26. The drive 26 includes a servomotor 27 and a worm gear 25 which drives a pinion secured to the carrier 24. The control of the carriage for movement in the direction toward and away from the hydraulic shears 1 and for movement about the vertical axis of the carrier 24 is effected by rotational drives 28, 29. Rotational drive 28 is connected to the servomotor 20 while rotational drive 29 is connected to the servomotor 27. If greater precision is desired, the rotational drives can also be arranged in the driving lines, that is in the transmission.

Figure 1:
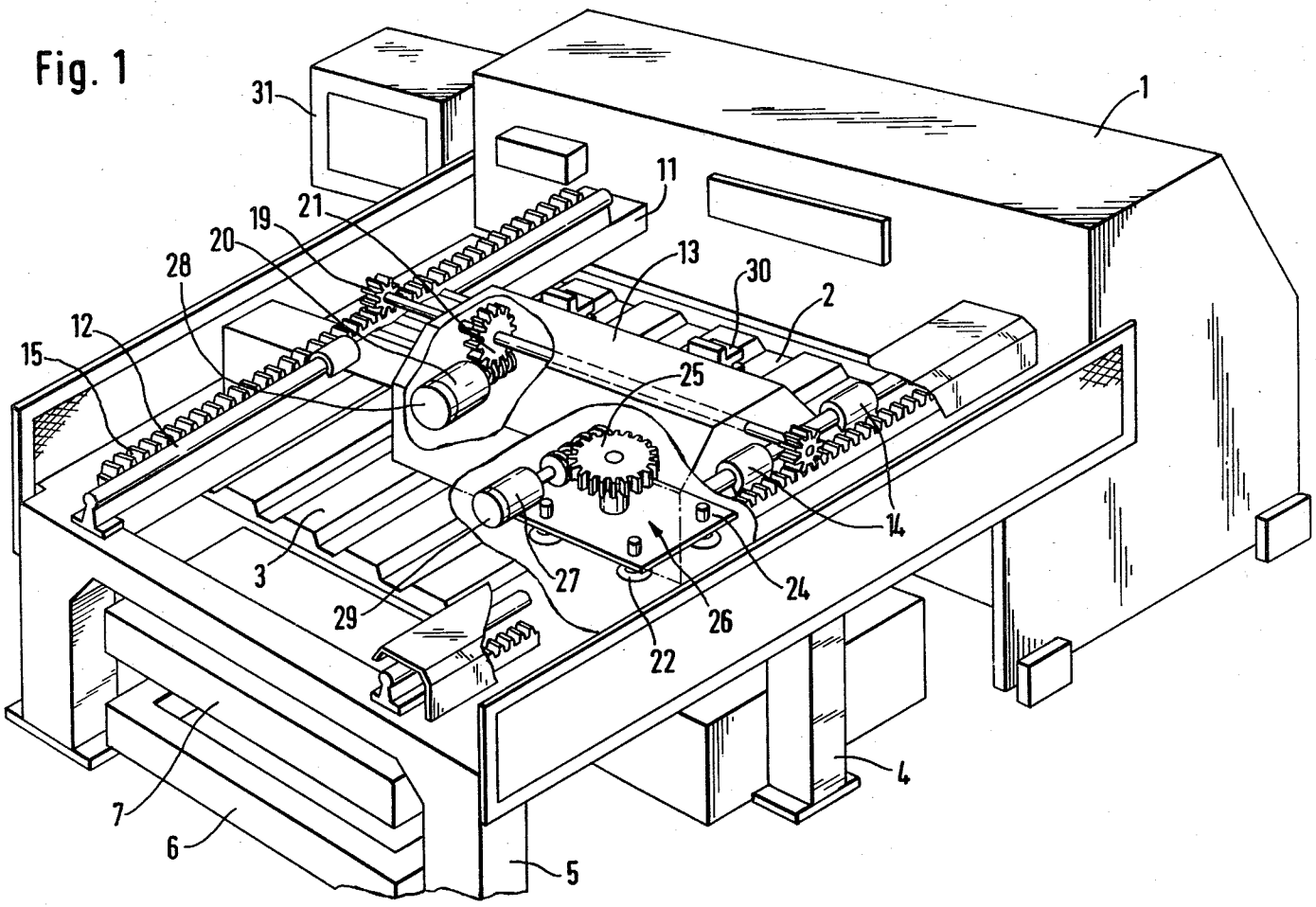
FIG. 1 is a perspective view of the plate feeding apparatus embodying the present invention.

In FIG. 1 two grippings collets 30 are shown on the front of carriage 13, that is the side of the carriage facing the hydraulic shears 1. The gripping collets 30 are equipped with lifting and clamping means, not shown. A NC-programming control console 31 is shown located to one side of the hydraulic shears 1. This numerical control programming device controls the operation of the plate feeding apparatus.

The following are several possible procedures for operating the plate feeding apparatus embodying the present invention.

WORKING METHOD I

A sheet metal plate 8 is picked up from the supply or plate feeder 7 by the vacuum suction devices 22 and then is moved on the carriage 13 over the sliding bars 12 on the rails 11 to the shear table 2 for effecting the first trimming cut. The vacuum suction devices 22 hold the plate down next to the clamps. After the first trimming cut is made, plate 8 is withdrawn out of the range of the hydraulic shears 1 by the vacuum suction device 22 and the carrier 24 is then turned by the rotary drive 26 through 180° and then is returned into the shears where the plate can be cut into strips after a trimming cut is made. Further, a measured cut can also be made at the same time.

If the shearing step performed along the narrow sides of the plate are to be accurate, the cutting of these sides can be effected in the same manner, that is, by withdrawing the plate away from the shears, turning the plate through the desired angle, and returning the plate into the shears for the cutting action.

In all of these operations, the cutting of the sheet metal strips and larger blanks can be effected with the plates held by the vacuum suction devices 22 until the plate size or the size of the blanks becomes smaller than the circle of rotation formed by the vacuum suction devices 22.

WORKING METHOD II

With smaller blanks, when the operation can no longer be carried out with the vacuum suction devices 22, the sheet metal plates are transferred to the collets 30. Initially, the trimming cuts are made in the manner described in Working Method I. In the final trimming cut the hold-down clamps on the shears are left in the clamped position, the vacuum suction devices 22 are released and lifted, and the carriage 13 is moved back away from the shears by the required amount. The collets 30 are lowered and the carriage 13 advances the collets into the clamped position. Collets 30 are then closed and sheet metal plates 8 can be cut into strips of any width down to the last clamped strip.

Due to the interaction of the movement in the direction toward the shears 1 and the movement about the axis of rotation, which permits a lifting action, blanks of any form can be produced as long as they are made with straight cuts. By NC-programming they can be reproduced in a simple manner by setting the dimensions in the direction of movement toward the shears, starting from stop 9 on the plate feeder and by setting the required angle of rotation about the axis of rotation of the carrier 24.

WORKING METHOD III

Smaller blanks than those formed according to working method II can be produced by using an additional vacuum suction device having a smaller working diameter. This smaller device is powered by a rotary drive about an axis extending perpendicularly to the direction of movement of the plates from the feeder 7 to the shears 1. The smaller vacuum suction device can be positioned in front of the carriage, that is, on the side closer to the shears 1. The carrier 24 and vacuum suction devices 22 are located on the carriage, note the drawings. Under certain circumstances, the collets can be eliminated.

While specific embodiments of the invention have been shown and described in detail to illustrate the application of the inventive principles, it will be understood that the invention may be embodied otherwise without departing from such principles.

What is claimed is:

1. Plate feeding apparatus for use with a shearing device such as a device for shearing sheet metal plates, comprising a shear table, gripping means adapted to hold and introduce plates to the shearing device, a plate feeder arranged to supply plates to be cut with said plate feeder disposed in spaced relationship outwardly from said shear table, a carriage located above and extending between said shear table and said plate feeder, means for supporting said carriage, means for moving said carriage between said shear table and said plate feeder, means mounted on said carriage for lifting and holding plates, means for moving said lifting and holding means, a NC-programming circuit for controlling the movement of said means for moving said carriage and of said means for moving said holding means, wherein the improvement comprises that said lifting and holding means comprises a device mounted for rotation through 360°, and said gripping means being mounted on said carriage.

2. Plate feeding apparatus, as set forth in claim 1, wherein said rotatable device includes a carrier mounted on said carriage, and a plurality of vacuum suction members depending from said carrier for holding the plates.

3. Plate feeding apparatus, a set forth in claim 2, wherein said vacuum suction members being arranged on a circle concentric to the axis of rotation of said rotatable device.

4. Plate feeding apparatus, as set forth in claim 1, wherein said gripping means comprise gripping collets.

5. Plate feeding apparatus, as set forth in claim 1, wherein said means for supporting said carriage comprises a pair of rails disposed in laterally spaced relation and extending in the direction between said plate feeder and said shear table, a guide rack extending along each of said rails, said guide racks each being toothed, said means for moving said carriage comprising pinion gears engageable with said toothed guide racks, a servomotor in driving engagement with said pinion gears, each said rail comprising a sliding bar extending in the direction between said plate feeder and said shear table, and said carriage including bearings in sliding engagement with said sliding bars so that said carriage can be moved along said sliding bars between said plate feeder and said shear table.

6. Plate feeding apparatus, as set forth in claim 3, said device comprises a rotary drive for rotating said carrier through 360°, said rotary drive comprises a gear box unit including a worm gear, and a servomotor mounted on said gear box unit for driving said worm gear.

7. Plate feeding apparatus, as set forth in claim 5, wherein a second rack extends along and in substantially parallel relation with one of said guide racks, said second rack being toothed with the toothing therein being finer than the toothing in said guide rack and a pinion disposed in meshed engagement with said second rack for effecting more exact positioning of said carriage.

8. Plate feeding apparatus, as set forth in claim 6, wherein said rotatable device includes a rotational drive, a gear rim disposed concentrically around said worm gear, a pinion in intermeshed engagement with said gear rim and said worm gear, said gear rim in operable connection with said rotational drive for setting the angular position of said rotatable device.

9. Plate feeding apparatus, as set forth in claim 1, wherein said lifting and holding means comprises a second device mounted for rotation through 360°, said second device being mounted on the side of said carriage closer to the shearing device, and said second device being connected to said NC-programming circuit for providing the control of its rotational movement.

10. Plate feeding apparatus, as set forth in claim 1, including hold-down clamps associated with said shear table for retaining plates on said shear table so that said hold-down clamps can be used alternatively with said lifting and holding means.

* * * * *